United States Patent [19]

Sato et al.

[11] Patent Number: 4,750,952

[45] Date of Patent: Jun. 14, 1988

[54] COLD-ROLLED STEEL SHEETS

[75] Inventors: Susumu Sato; Mitsumasa Kurosawa; Hideo Suzuki; Takashi Obara; Kozo Tsunoyama, all of Chiba, Japan

[73] Assignee: Kawasaki Steel Corporation, Kobe, Japan

[21] Appl. No.: 755,500

[22] Filed: Jul. 15, 1985

[30] Foreign Application Priority Data

| | | | |
|---|---|---|---|
| Jul. 17, 1984 | [JP] | Japan | 59-146990 |
| Jun. 7, 1985 | [JP] | Japan | 60-122807 |
| Jul. 3, 1985 | [JP] | Japan | 60-144437 |

[51] Int. Cl.[4] ..... C22C 38/14

[52] U.S. Cl. ..... 148/320; 148/330; 420/126

[58] Field of Search ..... 148/36, 12 C, 12 F, 148/320, 330; 75/124, 123 M; 420/126

[56] References Cited

U.S. PATENT DOCUMENTS

| | | | |
|---|---|---|---|
| 4,331,488 | 5/1982 | Sudo et al. | 148/36 |

FOREIGN PATENT DOCUMENTS

| | | | |
|---|---|---|---|
| 0067878 | 12/1982 | European Pat. Off. . | |
| 0120976 | 10/1984 | European Pat. Off. . | |
| 0120976 | 10/1984 | European Pat. Off. . | |
| 2155620 | 7/1972 | Fed. Rep. of Germany . | |
| 2299408 | 8/1976 | France . | |
| 57-104627 | 6/1982 | Japan | 148/36 |
| 0591637 | 1/1984 | Japan | 148/36 |
| 8300334 | 4/1984 | PCT Int'l Appl. . | |
| 8401585 | 4/1984 | World Int. Prop. O. . | |

OTHER PUBLICATIONS

Japanese Laid Open Appln. No. 59-31,828-Intl. Cl. C 21 D 9/48, English Abstract, Publication Date: Feb. 21, 1984.

Japanese Laid Open Appln. No. 59-31,827-Intl. Cl. C 21 D 9/48, C 21 D 9/48, C 21 D 8/04, C 22 C 38/14, English Abstract, Publication Date: Feb. 21, 1984.

*Primary Examiner*—Deborah Yee

*Attorney, Agent, or Firm*—Balogh, Osann, Kramer, Dvorak, Genova & Traub

[57] ABSTRACT

A cold-rolled steel sheet for deep drawing having an improved bake hardenability, which comprises 0.005–0.015 wt % of C, not more than 1.0 wt % of Si, not more than 1.0 wt % of Mn, not more than 0.15 wt % of P, 0.005–0.10 wt % of Al, not more than 0.003 wt % of S and not more than 0.004 wt % of N provided that S+N is not more than 0.005 wt %, and Ti satisfying $1 \leqq Ti^*/C \leqq 20$, in which $Ti^*(\%) = Ti(\%) - (48/14)N(\%) - (48/32)S(\%)$. Such a cold-rolled steel sheet is obtained by continuously annealing the steel sheet after the cold rolling, provided that a residence time over a temperature region above recrystallization temperature is within 300 seconds.

2 Claims, 5 Drawing Sheets

COLD-ROLLED STEEL SHEETS

BACKGROUND OF THE INVENTION

1. Field of the Invention

This invention relates to cold-rolled steel sheets for deep drawing having an improved bake hardenability and a method of manufacturing the same.

2. Description of the Prior Art

Lately, there has been strong demand for an increase in the strength of automotive outer steel sheets as a weight-saving measure in automotive vehicles in order to improve fuel consumption. On the other hand, such steel sheets are desired to have a low yield strength, a high elongation, a high r-value and the like from a viewpoint of press formability.

From the above conflicting requirements, therefore, a desired steel sheet is demanded to be soft and have a good workability in the press forming and exhibit a property of increasing the yield strength or a so-called bake hardenability in the subsequent paint baking.

As regards the cold-rolled steel sheet having the bake hardenability and the method of manufacturing the same, there are descriptions on Ti-containing steel in Japanese Patent laid open No. 53-114,717, Nb-containing steel in Japanese Patent laid open No. 57-70,258, and Ti and Nb-containing steel in Japanese Patent laid open No. 59-31,827. In any case, the bake hardenability is imparted without deterioration of other properties by controlling the amounts of Ti, Nb added or the cooling rate in the annealing to make the amount of solute carbon in steel proper.

However, if it is intended to leave the solute carbon by controlling the addition amounts of Ti, Nb, the properties of the steel sheet are considerably influenced by the delicate change of the addition amount. That is, when the addition amount of Ti, Nb is outside the predetermined range, the properties exerting on formabilities such as elongation, r-value and the like are degraded or the bake hardenability is not obtained satisfactorily. Therefore, the exact or precise control of the addition amount is considered to be significant in the production step.

SUMMARY OF THE INVENTION

It is an object of the invention to advantageously solve the aforementioned problems in case of restricting the addition amounts of carbonitride-forming elements such as Ti, Nb and so on and to provide cold-rolled steel sheets for deep drawing having a stable bake hardenability by restricting amounts of S and N to be bonded to Ti.

As to the amounts of each S and N, Japanese Patent laid open No. 58-110,659 mentions that S is limited to a range of 0.001–0.020% by weight and N is limited to not more than 0.0035%, while Japanese Patent laid open No. 58-42,752 mentions that N is limited to not more than 0.0025%. However, the former is only to prevent the occurrence of surface defects by reducing the amounts of Ti and B, and the latter is only to improve the secondary workability and r-value.

The inventors have made studies with respect to the relation between the amount of S, N and the properties in Ti-containing extremely low carbon steel and found that a high bake hardenability is obtained by limiting the amount of each of S and N and the total amount of S and N to specified ranges and restricting the addition amount of Ti to the specified range in consideration of the S, N amounts, and as a result the invention has been accomplished.

According to a first aspect of the invention, there is the provision of a cold-rolled steel sheet for deep drawing having an improved bake hardenability and comprising 0.0005 to 0.015% by weight of C, no more than 1.0% by weight of Si, not more than 1.0% by weight of Mn, not more than 0.15% by weight of P, 0.005 to 0.100% by weight of Al, not more than 0.003% by weight of S and not more than 0.004% by weight of N provided that the value of S+N is not more than 0.005% by weight, Ti corresponding to Ti(wt%) represented by the following equation (1) when an effective Ti content expressed by Ti* in the equation (1) satisfies the following inequality (2), and the balance being substantially Fe with inevitable impurities.

$$Ti^*(wt\%) = Ti(wt\%) - (48/14)N(wt\%) - (48/32)S(wt\%) \quad (1)$$

$$1 \times C(wt\%) \leqq Ti^*(wt\%) \leqq 20 \times C(wt\%) \quad (2)$$

In the preferred embodiment of the invention, the effective Ti content (Ti*) is 1 to less than 4 times of the C content (wt%). Further, the steel sheet may further include at least one of not more than 0.05% by weight of Nb and not more than 0.0050% by weight of B.

According to a second aspect of the invention, there is the provision of a method of manufacturing a cold-rolled steel sheet for deep drawing having an improved brake hardenability, which comprises the steps of:

melting a steel material containing 0.0005 to 0.015% by weight of C, not more than 0.003% by weight of S and not more than 0.004% by weight of N, provided that the value of S+N is not more than 0.005% by weight, and Ti corresponding to Ti (wt%) represented by the following equation (1) when an effective Ti amount expressed by Ti* in the equation (1) satisfies the following inequality (2);

continuously casting the resulting molten steel to produce a cast slab;

hot rolling the resulting cast slab;

cold rolling the resulting hot-rolled sheet; and subjecting the resulting cold-rolled sheet to a continuous annealing inclusive of heating and cooling, provided that a residence time over a temperature region above recrystallization temperature is within 300 seconds.

$$Ti^*(wt\%) = Ti(wt\%) - (48/14)N(wt\%) - (48/32)S(wt\%) \quad (1)$$

$$1 \times C(wt\%) \leqq Ti^*(wt\%) \leqq 20 \times C(wt\%) \quad (2)$$

In a preferred embodiment of the invention, the cast slab is heated at a heating temperature of not less than 1,150° C. before the hot rolling step.

DETAILED DESCRIPTION OF THE INVENTION

First, the invention will be described in terms of experiment results upon which the invention has been based.

Figure 1:
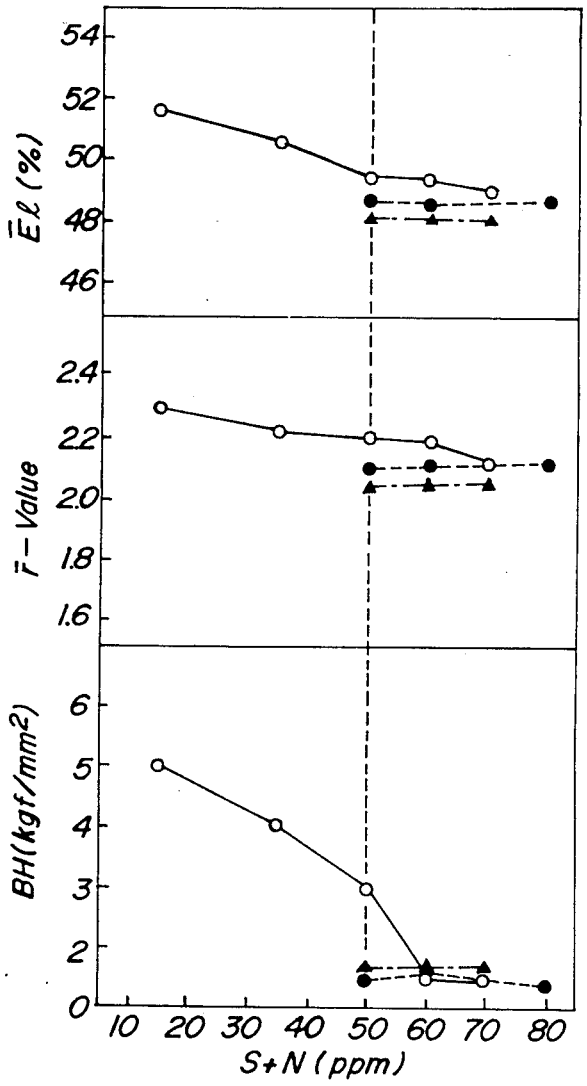
FIGS. 1 and 2 are graphs showing a relation between the amount of (S+N) in steel and the properties of the steel sheet, respectively.
Figure 2:
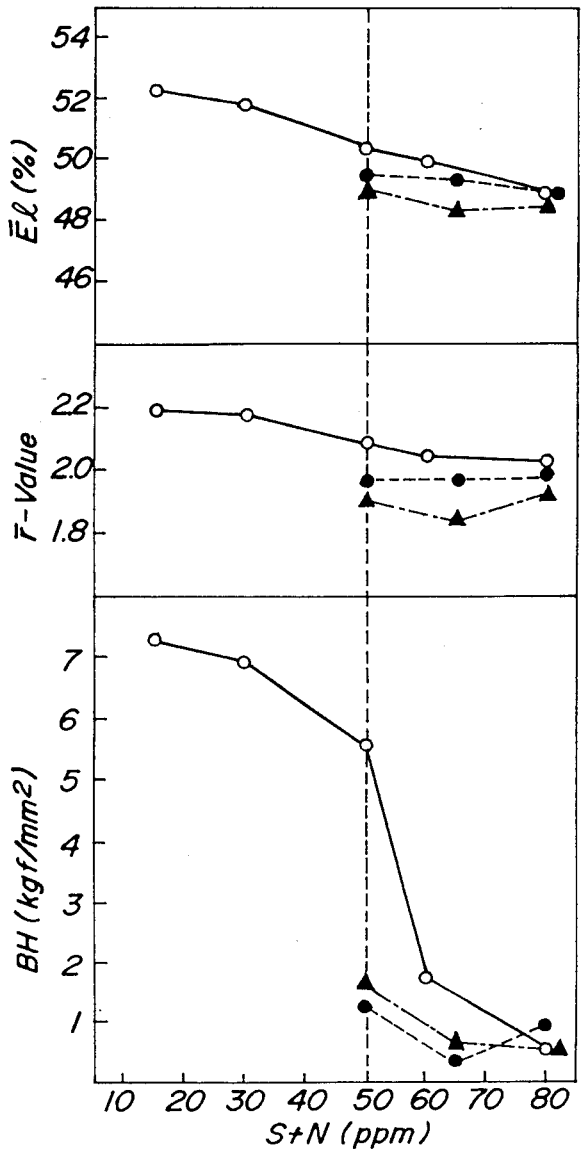

A slab of vacuum molten steel comprising 0.0015% of C, 0.1% of Mn, 0.04% of Al and variable amounts of N, S and Ti was hot rolled to a thickness of 3.5 mm and then cold rolled to a thickness of 0.8 mm in a laboratory. Then, the cold-rolled sheet was subjected to a heat treatment under such a heat cycle that the sheet was soaked at 800° C. for 40 seconds, which was temper rolled at a reduction of about 0.8%. In this sheet, the effect or influence of the (S+N) amount on bake hardenability (hereinafter abbreviated as BH), $\bar{r}$-value and total elongation (hereinafter abbreviated as El) was examined to obtain results as shown in FIGS. 1 and 2.

Figure 3:
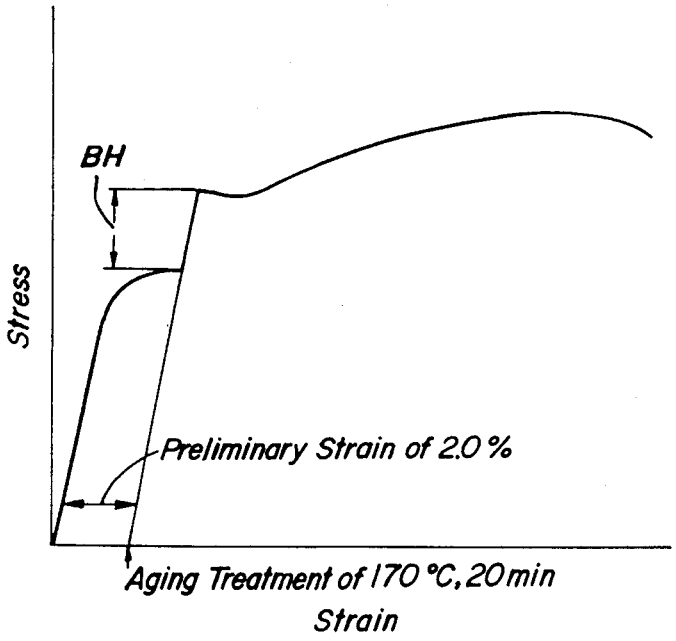
FIG. 3 is a graph illustrating an outline for the measurement of bake hardenability.

Moreover, BH was evaluated by measuring the increasing amount of yield point when applying a preliminary strain of 2% and subjecting to an aging treatment corresponding to a baking at 170° C. and 20 minutes duration as shown in FIG. 3. Each of the $\bar{El}$ value and $\bar{r}$-value obtained was an average of the measured values with respect to three test pieces sampled at three angles of 0°, 45° and 90° with respect to the rolling direction as calculated according to the following equations:

$$\bar{El} = \frac{El_0 + El_{90} + 2El_{45}}{4}$$

$$\bar{r} = \frac{r_0 + r_{90} + 2\,r_{45}}{4}$$

In FIGS. 1 and 2, symbol o is the case of S≦30 ppm, symbol ● is the case of S=40 ppm and variable amount of N, and symbol ▲ is the case of N=45 ppm and variable amount of S. Moreover, FIG. 1 shows the data under the condition of 4≦Ti*/C≦20, while FIG. 2 particularly shows the data under the condition of 1≦Ti*/C<4.

As seen from FIG. 1, when S≦30 ppm, S+N≦50 ppm and 4≦Ti*/C≦20, BH of at least 2 kgf/mm$^2$ can be obtained and is enhanced without degrading $\bar{El}$ and $\bar{r}$-values as the total amount of S+N becomes smaller. On the other hand, when S=40 ppm or N=45 ppm, even if S+N=50 ppm, BH is 1.5 kgf/mm$^2$ at most. Particularly, as seen from FIG. 2, when 1≦Ti*/C<4 under S≦30 ppm and S+N≦50 ppm, BH of 5.5 kgf/mm$^2$ or more is obtained without degrading the $\bar{El}$ and $\bar{r}$-values.

Although the reason why BH of at least 2 kgf/mm$^2$ is obtained as shown in FIGS. 1 and 2 is not clear, it is considered to be due to the following facts. That is, Ti in steel forms precipitates of TiS and TiN by the reaction with S and N before the formation of TiC. Therefore, in order to fix C as TiC, it is required to consider a ratio of effective Ti amount obtained by subtracting amount of Ti bonded to S and N from total Ti amount (Ti*=Ti−(48/32)S−(48/14)N) to C amount. In this point, Ti*/C=4 by weight ratio means that atomic ratio of Ti to C is 1:1, which is a measure for completely fixing C as TiC. Thus, it is common that when Ti*/C≧4 under equilibrium state, even if all of C amount is precipitated as TiC, an excess amount of Ti still remains without producing solute C.

The inventors have found from various studies and experiments that since the precipitation of TiC is progressed by utilizing TiS and TiN as a precipitation site, it is difficult to precipitate TiC by reducing TiS and TiN or the amounts of S and N. Therefore, even if 20≧Ti*/C≧4, solute C can be left under metastable condition, which contributes to the improvement of BH as shown in FIG. 1. On the other hand, when 1≦Ti*/C<4, a proper amount of solute C can stably be held, which contributes to the considerable increase of BH as shown in FIG. 2.

According to the invention, the reason why the composition of the steel is limited to the above ranges is mentioned as follows.

C:

The C content is advantageous as low as possible for improving the properties of steel. When it exceeds 0.015%, even if the amount of Ti added as mentioned later is increased, the good drawability can not be obtained. On the other hand, if the C content is less than 0.0005%, aimed at by the invention can not be obtained. Thus, the C content is restricted to a range of 0.0005 to 0.015%.

Si, Mn:

Each of Si and Mn effectively contributes to increase the strength of steel sheet without the degradation of deep drawability. However, when Si and Mn are more than 1.0%, respectively, the elongation and drawability of steel sheet are considerably degraded. Therefore, Si and Mn are restricted to not more than 1.0%, respectively.

P:

P is effective for increasing the strength of steel sheet without the degradation of deep drawability likewise the case of Si and Mn. However, if P is more than 0.15%, the elongation and drawability of steel sheet are considerably degraded. Therefore, P is restricted to not more than 0.15%.

Al:

Al is added in amount of not less than 0.005% for deoxidation or the like. On the other hand, the addition of more than 0.001% of Al adversely affects the surface properties of steel sheet. Thus, Al is restricted to a range of 0.005–0.100%.

S, N:

S and N in steel are most important ingredients according to the invention. As apparent from the aforementioned experimental results, S≦0.003%, N≦0.004% and S+N≦0.005% are required to advantageously provide the improved bake hardenability.

Ti:

Ti is added for fixing S, N and C. In this case, when the effective Ti amount [Ti*(%)=Ti(%)−(48/14)N(%)−(48/32)S(%)] is within a range of 1 to 20 times of C content, the bake hardenability of at least 2 kgf/mm$^2$ aimed at by the invention can be obtained with the high r-value. If Ti* is less than 1 times of C content (or atomic ratio of Ti*/C is less than 0.25), solute C excessively remains in steel, which is apt to cause yield elongation. On the other hand, the excess addition of Ti causes the degradation of the surface properties of steel sheet and becomes disadvantageous in view of the cost, so that the upper limit of Ti* is restricted to 20 times of C content.

In the steel sheet of the above composition, at least one of Nb and B may be added to enhance r-value and El without damaging the bake hardenability aimed at by the invention. However, when Nb is more than 0.05% and B is more than 0.0050%, the addition effect is saturated and the cost becomes disadvantageous, so that the upper limits of Nb and B are restricted to not more than 0.05% and not more than 0.0050%, respectively.

Moreover, not more than 1.0% of each of Cr, Cu, V and Zr and not more than 0.05% of each of Sb and Ca may be added, if necessary, because they do not degrade BH and deep drawability.

According to the invention, the cold-rolled steel sheet having the above composition is produced by forming a steel tapped from a converter or an electric furnace into a slab by an ingot making-slabbing process or a continuous casting process, hot rolling and cold rolling the slab and continuously annealing the cold-rolled sheet while holding over a temperature region above recrystallization temperature within 300 seconds.

In this connection, a slab of vacuum molten steel comprising 0.0020% of C, 0.1% of Mn, 0.04% of Al, 0.026% of Ti, 0.0022% of S and 0.0019% of N (i.e. $Ti^*/C \cong 8.1$) was hot rolled to a thickness of 3.5 mm and then cold rolled to a thickness of 0.8 mm in a laboratory. Moreover, the recrystallization temperature of the cold-rolled sheet was 660° C.

Figure 4:
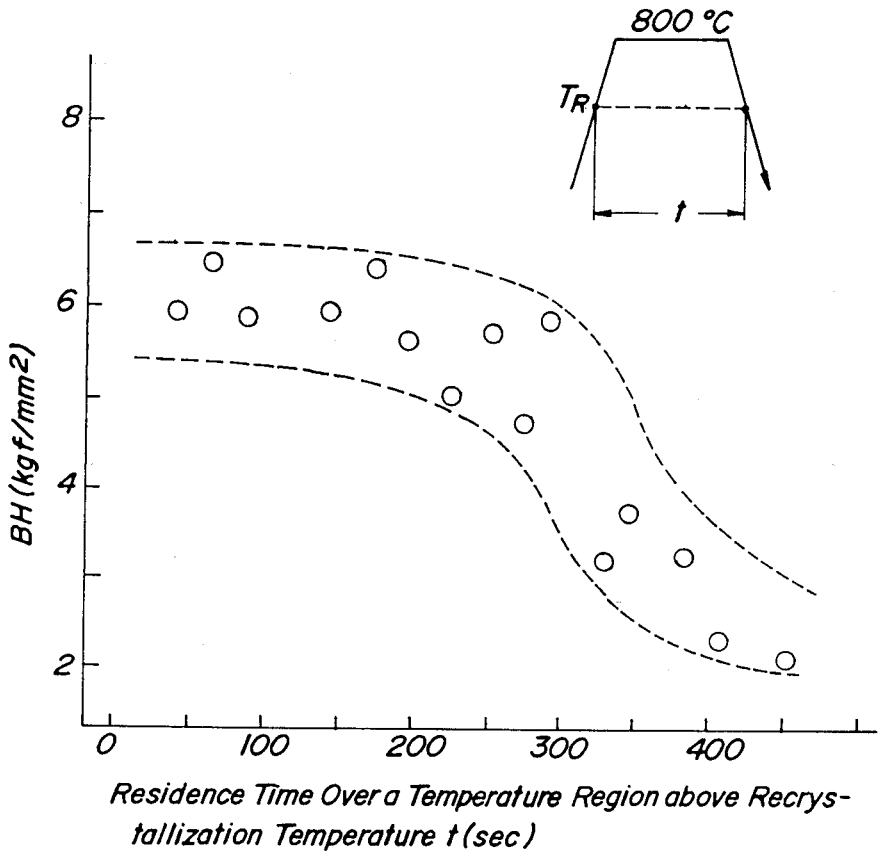
FIG. 4 is a graph showing an influence of residence time over a temperature region above recrystallization temperature on bake hardenability.

In FIG. 4 is shown a relation between BH and residence time, t (sec) over a temperature region above recrystallization temperature ($T_R$) when the above cold-rolled sheet is subjected to continuous annealing under such conditions that the heating and cooling rates are 10° C./sec, respectively and the soaking time is varied.

As seen from FIG. 4, the high BH value can stably be obtained when the residence time over the temperature region above the recrystallization temperature is within 300 seconds. This is cosidered due to the fact that the long-term annealing becomes disadvantageous for the securing of solute C because the precipitation of TiC progresses during the annealing. In the continuous annealing inclusive of heating and cooling, therefore, the residence time over the temperature region above the recrystallization temperature must be shortened and is within 300 seconds, preferably 100 seconds.

Figure 5:
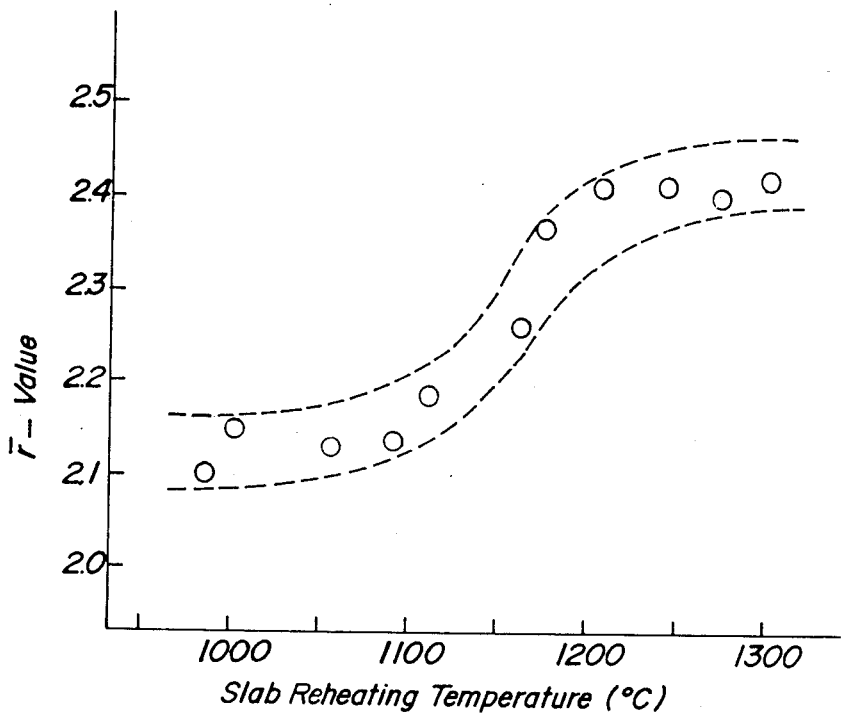
FIG. 5 is a graph showing a relation between slab reheating temperature and $\bar{r}$-value.

Moreover, a relation between the slab reheating temperature before the hot rolling and the $\bar{r}$-value of the steel sheet after the continuous annealing was examined to obtain results as shown in FIG. 5. In the continuous annealing, the residence time over the temperature region above the recrystallization temperature (660° C.) was 140 seconds and the soaking temperature was 800° C.

As seen from FIG. 5, the $\bar{r}$-value is considerably enhanced when the slab reheating temperature is not less than 1,150° C. This is considered due to the fact that when the slab is reheated at higher temperature, the distribution and morphology of the composite precipitate of TiS and TiC in the hot-rolled sheet change to advantageously develop the recrystallization texture of {111} in the cold rolling and annealing.

As a result of subsequent experiments, it has been confirmed that when the slab reheating temperature is not less than 1,150° C., steel sheets having a considerably high $\bar{r}$-value with a high BH value can be obtained irrespective of the heat history of the slab to be heated, the hot rolling conditions and the coiling temperature.

The cold-rolled steel sheets according to the invention are excellent in the phosphate treating property, hot dipping property and secondary workability and may be used as an original steel sheet for surface treatment such as electric zinc coating or the like.

The following examples are given in the illustration of the invention and are not intended as limitations thereof.

EXAMPLE 1

Each of steel materials having a chemical composition as shown in Table 1 was melted in a converter, subjected to a degassing treatment under vacuum, and then cast by a continuous casting apparatus to form a slab.

This slab was hot rolled and cold rolled in usual manner to form a cold-rolled steel sheet having a thickness of 0.8 mm, which was subjected to a continuous annealing (soaking conditions: 800° C., 30 seconds) and a temper rolling (reduction: 0.5–1%). The mechanical properties of the thus obtained products are shown in Table 2. The mechanical properties were all measured by using JIS No. 5 test pieces.

Each of $\overline{YS}$, $\overline{TS}$, $\overline{El}$ and $\bar{r}$-value is the average value $$\left(\bar{x} = \frac{x_0 + x_{90} + 2x_{45}}{4}\right)$$

of test results with respect to the rolling direction ($x_0$), 45° to the rolling direction ($x_{45}$), and 90° to the rolling direction ($x_{90}$). YEl, BH and aging index AI (increment in yield point after aging under preliminary strain of 7.5% at 100° C. for 30 minutes) are test results with respect to the test piece sampled in parallel with the rolling direction.

TABLE 1

| Steel No. | C | Si | Mn | S | P | Al | N | Ti | Ti*/C | others | Remarks |
|---|---|---|---|---|---|---|---|---|---|---|---|
| 1 | 0.0013 | 0.02 | 0.10 | 0.0019 | 0.010 | 0.040 | 0.0010 | 0.013 | 5.2 | — | Invention |
| 2 | 0.0021 | 0.01 | 0.10 | 0.0012 | 0.011 | 0.035 | 0.0014 | 0.025 | 8.8 | — | Steel |
| 3 | 0.0120 | 0.01 | 0.15 | 0.0023 | 0.015 | 0.042 | 0.0020 | 0.060 | 4.1 | — | |
| 4 | 0.0032 | 0.01 | 0.10 | 0.0018 | 0.012 | 0.055 | 0.0020 | 0.026 | 5.1 | — | |
| 5 | 0.0005 | 0.02 | 0.10 | 0.0005 | 0.013 | 0.055 | 0.0025 | 0.012 | 5.4 | — | |
| 6 | 0.0018 | 0.02 | 0.13 | 0.0052 | 0.012 | 0.044 | 0.0020 | 0.023 | 4.6 | — | Comparative |
| 7 | 0.0015 | 0.02 | 0.11 | 0.0025 | 0.012 | 0.035 | 0.0040 | 0.026 | 5.7 | — | Steel |
| 8 | 0.0210 | 0.03 | 0.20 | 0.0021 | 0.015 | 0.045 | 0.0020 | 0.102 | 4.4 | — | |
| 9 | 0.0015 | 0.02 | 0.10 | 0.0012 | 0.010 | 0.040 | 0.0015 | 0.014 | 4.7 | Nb = 0.008 | Invention |
| 10 | 0.0022 | 0.01 | 0.12 | 0.0013 | 0.02 | 0.040 | 0.0014 | 0.024 | 7.8 | B = 0.0020 | Steel |
| 11 | 0.0032 | 0.72 | 0.61 | 0.0012 | 0.01 | 0.027 | 0.0012 | 0.068 | 19.4 | — | |
| 12 | 0.0025 | 0.02 | 0.24 | 0.0008 | 0.13 | 0.046 | 0.0024 | 0.024 | 5.8 | — | |
| 13 | 0.0046 | 0.55 | 0.70 | 0.0022 | 0.09 | 0.032 | 0.0021 | 0.034 | 5.1 | — | |

TABLE 2

| Steel No. | $\overline{YS}$ (kgf/mm²) | $\overline{TS}$ (kgf/mm²) | $\overline{El}$ (%) | $\bar{r}$ | YEl (%) | BH (kgf/mm²) | AI (kgf/mm²) | Remarks |
|---|---|---|---|---|---|---|---|---|
| 1 | 13.2 | 30.2 | 52 | 2.2 | 0 | 3.5 | 2.5 | Invention |
| 2 | 14.2 | 30.5 | 51 | 2.1 | 0 | 4.2 | 3.0 | Steel |
| 3 | 17.2 | 32.2 | 50 | 2.0 | 0 | 5.2 | 3.4 | |
| 4 | 15.1 | 32.1 | 52 | 2.2 | 0 | 3.2 | 3.2 | |
| 5 | 12.8 | 30.8 | 54 | 2.2 | 0 | 4.0 | 2.9 | |
| 6 | 15.2 | 30.5 | 50 | 2.2 | 0 | 1.2 | 0 | Comparative |
| 7 | 15.5 | 31.3 | 51.2 | 2.1 | 0 | 0.8 | 0 | Steel |
| 8 | 19.3 | 33.4 | 44.0 | 1.6 | 0 | 4.2 | 3.2 | |
| 9 | 14.0 | 30.0 | 53 | 2.3 | 0 | 4.1 | 3.0 | Invention |
| 10 | 13.2 | 29.8 | 54 | 2.2 | 0 | 3.5 | 2.4 | Steel |
| 11 | 20.5 | 36.1 | 44 | 1.9 | 0 | 3.1 | 1.8 | |
| 12 | 22.5 | 39.4 | 41 | 2.2 | 0 | 4.8 | 2.9 | |
| 13 | 23.6 | 41.0 | 39 | 2.0 | 0 | 3.8 | 2.6 | |

In the steel sheets according to the invention, r-value of not less than 1.9 and BH of not less than 3.2 kgf/mm² were obtained.

However, with respect to Comparative Steel No. 6 in which the S content was outside of the range defined in the invention and Comparative Steel No. 7 in which the total amount of S+N was outside the range defined in the invention, BH was as low as 1.2 kgf/mm² and 0.8 kgf/mm², respectively. Further, with respect to Comparative Steel No. 8 in which the C content was in excess, El and $\bar{r}$-value were deteriorated.

EXAMPLE 2

Each of steel materials (Nos. 14–17) having a chemical composition as shown in Table 3 was melted in a converter, subjected to a degassing treatment under vacuum and continuously cast to form a slab.

The slab thus obtained was hot rolled and then cold rolled in usual manner to form a cold-rolled steel sheet having a thickness of 0.8 mm, which was subjected to a continuous annealing (soaking conditions: 800° C., 30 seconds) and a temper rolling (reduction: 0.5–1%).

The mechanical properties of the products thus obtained were examined in the same manner as in Example 1 to obtain results as shown in Table 4.

TABLE 3

| Steel No. | C | Si | Mn | P | S | Al | N | Ti | Ti*/C | others | Remarks |
|---|---|---|---|---|---|---|---|---|---|---|---|
| 14 | 0.0008 | 0.01 | 0.10 | 0.011 | 0.0025 | 0.042 | 0.0020 | 0.013 | 3.0 | — | Invention |
| 15 | 0.0018 | 0.01 | 0.11 | 0.010 | 0.0021 | 0.032 | 0.0008 | 0.011 | 2.8 | — | Steel |
| 16 | 0.0033 | 0.01 | 0.09 | 0.010 | 0.0005 | 0.039 | 0.0016 | 0.016 | 3.0 | — | |
| 17 | 0.0122 | 0.02 | 0.10 | 0.009 | 0.0011 | 0.050 | 0.0021 | 0.053 | 3.6 | — | |
| 18 | 0.0018 | 0.96 | 0.36 | 0.011 | 0.0014 | 0.030 | 0.0018 | 0.014 | 3.2 | — | |
| 19 | 0.0043 | 0.01 | 0.92 | 0.043 | 0.0020 | 0.028 | 0.0011 | 0.020 | 3.1 | — | |
| 20 | 0.0056 | 0.02 | 0.20 | 0.131 | 0.0014 | 0.018 | 0.0025 | 0.021 | 1.8 | — | |
| 21 | 0.0016 | 0.02 | 0.10 | 0.016 | 0.0013 | 0.043 | 0.0018 | 0.013 | 3.0 | Nb = 0.007 | |
| 22 | 0.0014 | 0.02 | 0.12 | 0.010 | 0.0015 | 0.043 | 0.0018 | 0.013 | 3.3 | B = 0.0021 | |
| 23 | 0.0018 | 0.01 | 0.10 | 0.009 | 0.0015 | 0.044 | 0.0020 | 0.015 | 3.3 | Nb = 0.007<br>B = 0.0016 | |
| 24 | 0.0015 | 0.01 | 0.10 | 0.010 | 0.0015 | 0.040 | 0.0020 | 0.016 | 4.6 | — | |
| 25 | 0.0020 | 0.02 | 0.11 | 0.012 | 0.0049 | 0.041 | 0.0018 | 0.019 | 2.7 | — | Comparative |
| 26 | 0.0018 | 0.02 | 0.11 | 0.010 | 0.0020 | 0.038 | 0.0042 | 0.023 | 3.1 | — | Steel |
| 27 | 0.0200 | 0.01 | 0.11 | 0.011 | 0.0012 | 0.040 | 0.0022 | 0.065 | 2.8 | — | |

TABLE 4

| Steel No. | $\overline{YS}$ (kgf/mm²) | $\overline{TS}$ (kgf/mm²) | $\overline{El}$ (%) | $\bar{r}$ | BH (kgf/mm²) | YEl after aging at room temperature for 3 months (%) | Remarks |
|---|---|---|---|---|---|---|---|
| 14 | 13.8 | 29.8 | 53 | 2.1 | 6.5 | 0 | Invention |
| 15 | 14.2 | 30.3 | 52 | 2.2 | 7.2 | 0 | Steel |
| 16 | 14.0 | 30.1 | 52 | 2.2 | 8.0 | 0 | |
| 17 | 14.7 | 31.2 | 50 | 1.9 | 6.6 | 0 | |
| 18 | 21.1 | 36.6 | 45 | 1.9 | 6.4 | 0.1 | |
| 19 | 22.0 | 38.9 | 42 | 1.8 | 6.7 | 0 | |
| 20 | 23.5 | 39.6 | 40 | 2.0 | 7.2 | 0.2 | |
| 21 | 13.8 | 29.9 | 54 | 2.3 | 7.5 | 0 | |
| 22 | 14.0 | 30.0 | 54 | 2.2 | 7.1 | 0 | |
| 23 | 14.8 | 30.6 | 54 | 2.2 | 7.2 | 0 | |
| 24 | 14.5 | 30.5 | 51 | 2.1 | 3.1 | 0 | |
| 25 | 15.0 | 31.3 | 49 | 1.9 | 1.6 | 0 | Comparative |
| 26 | 15.2 | 31.5 | 48 | 1.9 | 1.8 | 0 | Steel |
| 27 | 19.3 | 33.5 | 44 | 1.6 | 6.0 | 2.3 | |

In each of Steel Nos. 14–24 according to the invention, $\bar{r}$-value of not less than 1.8, BH of not less than 3.1 kgf/mm² and YEl of not more than 0.2% were obtained.

On the contrary, in each of Comparative Steel Nos. 25 and 26 in which the S or N content was outside the range defined in the invention, BH was extremely low. In Comparative Steel No. 27 in which the C content exceeded the upper limit, BH property was excellent, but $\overline{El}$ and $\bar{r}$-values were conspicuously deteriorated.

All of Steel Nos. 14–24 according to the invention were $2 \leqq AI \leqq 5$ kgf/mm$^2$.

EXAMPLE 3

Each of steel materials (Nos. 28–30) having a chemical composition as shown in Table 5 was melted in a converter, subjected to a degassing treatment under vacuum and continuously cast to form a slab.

The thus obtained slab was heated at 1,100°–1,220° C., hot rolled, and then cold rolled to form a cold-rolled steel sheet having a thickness of 0.8 mm, which was subjected to a continuous annealing.

In the continuous annealing under such a cycle that the steel sheet was heated to 820° C. and then cooled from this temperature, the residence time over a temperature region above the recrystallization temperature was varied. The mechanical properties and BH of the products thus obtained were examined to obtain results as shown in Table 6.

TABLE 5

| Steel No. | C | Si | Mn | P | S | Al | N | Ti | Ti*/C | others |
|---|---|---|---|---|---|---|---|---|---|---|
| 28 | 0.0018 | 0.01 | 0.10 | 0.011 | 0.0022 | 0.045 | 0.0018 | 0.022 | 7.0 | — |
| 29 | 0.0020 | 0.01 | 0.09 | 0.096 | 0.0019 | 0.042 | 0.0016 | 0.022 | 6.8 | — |
| 30 | 0.0024 | 0.01 | 0.10 | 0.009 | 0.0020 | 0.042 | 0.0014 | 0.026 | 7.6 | Nb:0.0050 B:0.0020 |

TABLE 6

| Steel No. | Residence time above recrystallization temperature (sec) | $\overline{YS}$ (kgf/mm$^2$) | $\overline{TS}$ (kgf/mm$^2$) | $\overline{El}$ (%) | $\bar{r}$ | BH (kgf/mm$^2$) |
|---|---|---|---|---|---|---|
| 28 | 50 | 13.3 | 29.6 | 52 | 2.1 | 7.2 |
| | 250 | 12.9 | 29.1 | 53 | 2.1 | 6.6 |
| | 360 | 12.4 | 28.8 | 53 | 2.1 | 2.6 |
| 29 | 50 | 20.7 | 37.0 | 41 | 2.0 | 7.6 |
| | 265 | 19.2 | 36.5 | 44 | 2.0 | 5.5 |
| | 450 | 19.0 | 35.8 | 44 | 2.0 | 3.3 |
| 30 | 45 | 12.8 | 29.0 | 52 | 2.2 | 7.0 |
| | 250 | 12.0 | 28.4 | 54 | 2.2 | 5.9 |
| | 330 | 11.8 | 28.0 | 54 | 2.2 | 2.2 |

As seen from Table 6, the high BH value was obtained with no problems in the mechanical properties when the residence time over the temperature region above the recrystallization temperature was within 300 seconds. In all products, AI was not less than 2 kgf/mm$^2$. By the way, the recrystallization temperature was 650° C., 720° C. and 760° C. in the cases of Steel No. 28, Steel No. 29 and Steel No. 30, respectively.

EXAMPLE 4

Each of steel materials A and B having a chemical composition as shown in Table 7 was melted in a converter, subjected to a degassing treatment under vacuum, and cast by a continuous casting apparatus to form a slab.

The thus obtained slab was heated and soaked at 1,090°–1,330° C. for 3–4 hours and then hot rolled. In this case, the hot rolling finish temperature and the coiling temperature were 910°–880° C. and 510°–600° C., respectively.

After being pickled, the hot-rolled steel sheet was cold rolled to form a cold-rolled steel sheet having a thickness of 0.8 mm, which was then subjected to a continuous annealing.

In the continuous annealing, the residence time over the temperature region above the recrystallization temperature was set in a range of 75–92 seconds, and the attained maximum temperature was 790°–820° C.

The properties of the steel sheet after the temper rolling at a reduction of 0.5–0.8% are shown in Table 8.

TABLE 7

| Steel | C | Si | Mn | P | S | Al | N | Ti | Ti*/C | Nb |
|---|---|---|---|---|---|---|---|---|---|---|
| A | 0.0032 | 0.02 | 0.06 | 0.013 | 0.0017 | 0.032 | 0.0020 | 0.025 | 4.9 | — |
| B | 0.0018 | 0.01 | 0.12 | 0.010 | 0.0024 | 0.018 | 0.0014 | 0.023 | 8.1 | 0.004 |

TABLE 8

| Steel | Slab heating temperature (°C.) | $\overline{YS}$ (kgf/mm$^2$) | $\overline{TS}$ (kgf/mm$^2$) | $\overline{El}$ (%) | $\bar{r}$ | BH (kgf/mm$^2$) |
|---|---|---|---|---|---|---|
| A | 1,330 | 13.5 | 29.0 | 52 | 2.5 | 5.7 |
| | 1,210 | 14.1 | 29.2 | 52 | 2.3 | 6.0 |
| | 1,090 | 14.5 | 28.6 | 52 | 2.0 | 5.8 |
| B | 1,280 | 12.6 | 27.6 | 54 | 2.6 | 5.6 |
| | 1,100 | 13.5 | 28.1 | 52 | 2.1 | 5.2 |

By setting the slab rehating temperature at 1,210°–1,330° C., the high BH value was ensured, and $\bar{r}$-value of 2.3 to 2.6 and AI of not less than 2 kgf/mm$^2$ were obtained.

As mentioned above, according to the invention, the proper bake hardenability can be obtained together with the deep drawability in the cold-rolled sheet of extremely low carbon aluminum killed steel by restricting S, N and S+N amounts in steel to particular ranges and satisfying $1 \leqq Ti^*C/ \leqq 20$ as the Ti amount. Particularly, the proper bake hardenability is advantageously ensured by the continuous annealing under the specified recrystallization annealing conditions.

What is claimed is:

1. A cold-rolled steel sheet for deep drawing having an improved bake hardenability and consisting essentially of 0.0005 to 0.005% by weight of C, not more than 1.0% by weight of Si, not more than 1.0% by weight of Mn, not more than 0.15% by weight of P, 0.005 to 0.100% by weight ofAl, not more than 0.003% by weight of S and not more than 0.004% by weight of N provided that the value of S+N is not more than 0.005% by weight, r-value of not less than 1.9, BH of not less than 3.2 kgf/mm$^2$ and El% of 50 or more, Ti corresponding to Ti (wt%) represented by the following equation (1) when an effective Ti content expressed by Ti* in the equation (1) satisfies the following inequality (2), and the balance being Fe with inevitable impurities:

$$Ti^*(wt\%) = Ti(wt\%) - (48/14)N(wt\%) - (48/32)S(wt\%) \quad (1)$$

$$1 \times C(wt\%) \leqq Ti^*(wt\%) \leqq 20 \times C(wt\%) \quad (2).$$

2. The cold-rolled steel sheet according to claim 1, wherein said steel sheet further includes at least one of not more than 0.05% by weight of Nb and not more than 0.0050% by weight of B.

* * * * *